US008787787B2

(12) United States Patent
Tanaka

(10) Patent No.: US 8,787,787 B2
(45) Date of Patent: Jul. 22, 2014

(54) IMAGE FORMING APPARATUS DISCHARGING OZONE FROM CHARGER

(75) Inventor: Yoshiaki Tanaka, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 153 days.

(21) Appl. No.: 13/587,528

(22) Filed: Aug. 16, 2012

(65) Prior Publication Data

US 2013/0051836 A1 Feb. 28, 2013

Related U.S. Application Data

(60) Provisional application No. 61/528,651, filed on Aug. 29, 2011.

(51) Int. Cl.
*G03G 21/20* (2006.01)

(52) U.S. Cl.
USPC ..... 399/92; 399/93; 399/100

(58) Field of Classification Search
CPC . G03G 15/0258; G03G 15/052; G03G 21/20; G03G 21/206
USPC ..... 399/93, 99, 100, 173, 92
See application file for complete search history.

(56) References Cited

U.S. PATENT DOCUMENTS

| | | | | |
|---|---|---|---|---|
| 5,532,798 | A * | 7/1996 | Nakagami et al. | 399/170 |
| 7,302,211 | B2 * | 11/2007 | Deguchi et al. | 399/171 |
| 7,512,355 | B2 * | 3/2009 | Fujii et al. | 399/92 |
| 7,835,667 | B2 * | 11/2010 | Ohno et al. | 399/171 |
| 2009/0052933 | A1 * | 2/2009 | Sata | 399/92 |

FOREIGN PATENT DOCUMENTS

| | | |
|---|---|---|
| JP | 07-301977 | 11/1995 |
| JP | 2002-304046 | 10/2002 |

* cited by examiner

*Primary Examiner* — David Gray
*Assistant Examiner* — Carla Therrien
(74) *Attorney, Agent, or Firm* — Patterson & Sheridan, LLP

(57) ABSTRACT

A charger according to an embodiment includes: a discharge member which faces an image carrier; a case which supports the discharge member and comprises an air hole in a first surface; a cleaner which contacts with the discharge member; and a cleaner support member which comprises an inlet port and an outlet port connecting with the air hole and a ventilation unit, supports the cleaner, and slides in relation to the case on the first surface.

10 Claims, 4 Drawing Sheets

IMAGE FORMING APPARATUS DISCHARGING OZONE FROM CHARGER

CROSS-REFERENCE TO RELATED APPLICATION

This application is based upon and claims the benefit of priority from Provisional U.S. Application 61/528,651 filed on Aug. 29, 2011, the entire contents of which are incorporated herein by reference.

FIELD

Embodiments described herein relate generally to a charger which is used for a copier, printer or the like and has a corona discharge.

BACKGROUND

In a copier, printer or the like, there is a charger which applies an electric charge by corona discharge and uniformly charges a photoconductive unit or transfers a toner image on the photoconductive unit onto a sheet. There is a risk that the charger having a corona discharge may cause deterioration of the photoconductive unit or operation failure due to ozone or the like generated at the time of corona discharge.

DETAILED DESCRIPTION

In general, according to one embodiment, a charger includes: a discharge member which faces an image carrier; a case which supports the discharge member and comprises an air hole in a first surface; a cleaner which contacts with the discharge member; and a cleaner support member which comprises an inlet port and an outlet port connecting with the air hole and a ventilation unit, supports the cleaner, and slides in relation to the case on the first surface.

Figure 1:
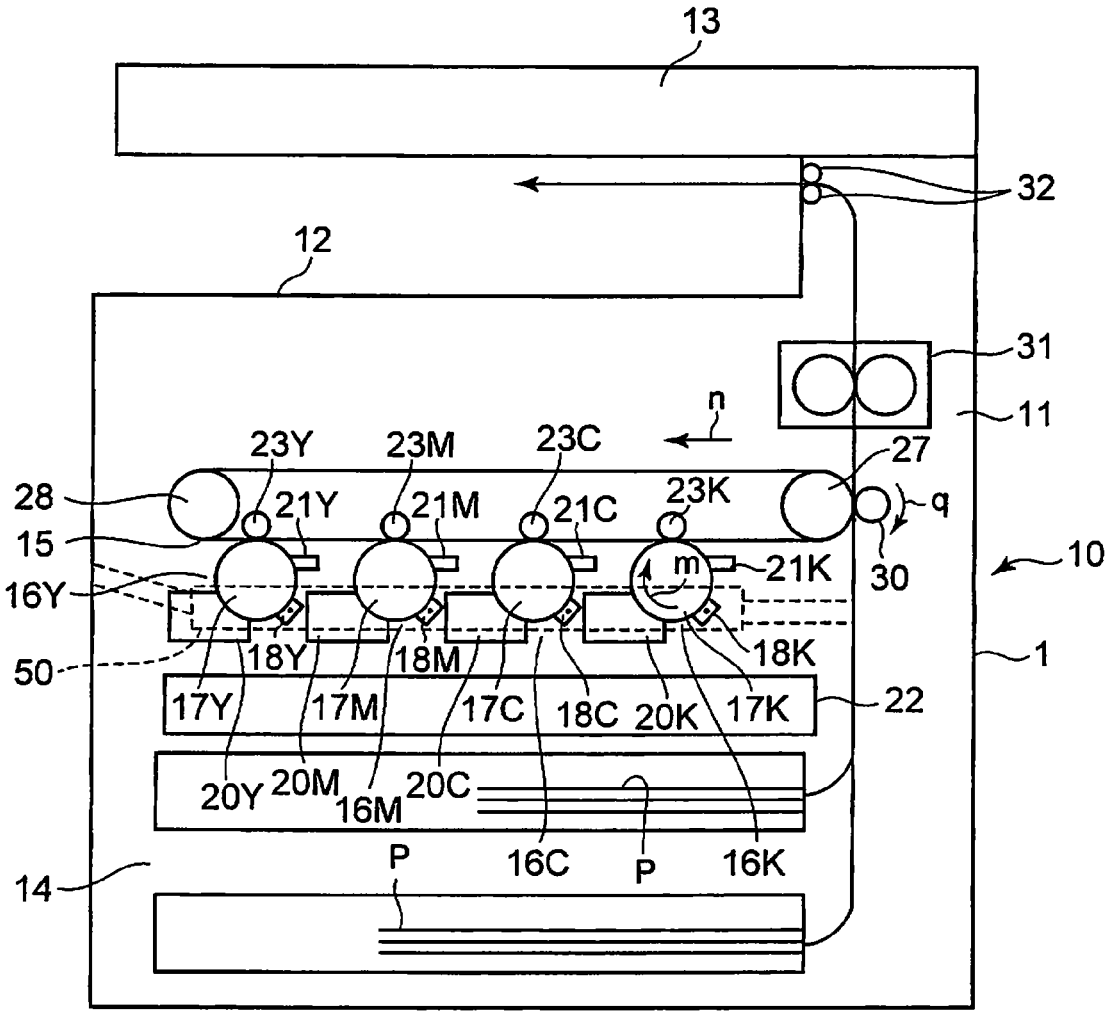
FIG. 1 is a schematic view of configuration showing an MFP equipped with a charger according to an embodiment.

An MFP (multi-functional peripheral) 10 as an image forming apparatus shown in FIG. 1 includes, within a casing 1 as a main body, a printer unit 11 which forms an image, a paper discharge unit 12 housing a sheet P discharged from the printer unit 11, and a paper supply unit 14 which supplies the sheet P. The MFP 10 includes a scanner unit 13 which reads an image on the upper side of the casing 1.

The printer unit 11 includes four image forming stations 16Y, 16M, 16C and 16K for Y (yellow), M (magenta), C (cyan) and K (black) arranged in parallel along a lower side of an intermediate transfer belt 15. The image forming stations 16Y, 16M, 16C and 16K include photoconductive drums 17Y, 17M, 17C and 17K as image carriers, respectively.

The image forming stations 16Y, 16M, 16C and 16K respectively include chargers 18Y, 18M, 18C and 18K, developing devices 20Y, 20M, 20C and 20K as developing units, and photoconductor cleaners 21Y, 21M, 21C and 21K, around the photoconductive drums 17Y, 17M, 17C and 17K rotating in a direction of arrow m. The printer unit 11 includes an exposure device 22 as a latent image forming unit. The exposure device 22 forms an electrostatic latent image corresponding to each color on the respective photoconductive drums 17Y, 17M, 17C and 17K.

The printer unit 11 includes a backup roller 27 and a driven roller 28 which support the intermediate transfer belt 15 and the printer unit 11 travel the intermediate transfer belt 15 in a direction of arrow n. The printer unit 11 includes primary transfer rollers 23Y, 23M, 23C and 23K at positions facing the photoconductive drums 17Y, 17M, 17C and 17K via the intermediate transfer belt 15. The primary transfer rollers 23Y, 23M, 23C and 23K perform primary transfer of toner images formed on the photoconductive drums 17Y, 17M, 17C and 17K onto the intermediate transfer belt 15 respectively. The toner images of each color are sequentially superimposed on the intermediate transfer belt 15. The photoconductor cleaners 21Y, 21M, 21C and 21K remove and collect the toner remaining on the photoconductive drums 17Y, 17M, 17C and 17K after primary transfer respectively.

The printer unit 11 includes a secondary transfer roller 30 at a position facing the backup roller 27 via the intermediate transfer belt 15. The secondary transfer roller 30 rotates in a direction of arrow q, following the intermediate transfer belt 15.

The paper supply unit 14 supplies a sheet P to the position of the secondary transfer roller 30 in time with the toner image on the intermediate transfer belt 15 reaching the position of the secondary transfer roller 30. At the time of secondary transfer, in the printer unit 11, a transfer bias is formed in a nip between the intermediate transfer belt 15 and the secondary transfer roller 30 and the toner images on the intermediate transfer belt 15 are collectively secondary-transferred onto the sheet P.

The printer unit 11 includes a ventilation unit 50 which ventilates the image forming stations 16Y, 16M, 16C and 16*k*. The printer unit 11 includes a fuser 31 and a paper discharge roller pair 32 downstream from the secondary transfer roller 30.

The MFP 10, through a print process, transfers the toner image formed by the printer unit 11 onto the sheet P, fixes the image and then discharges the sheet to the paper discharge unit 12.

The image forming apparatus is not limited to a tandem type, and the number of image forming stations is not limited. The image forming apparatus may transfer a toner image from the photoconductive unit directly to the sheet.

Figure 2:
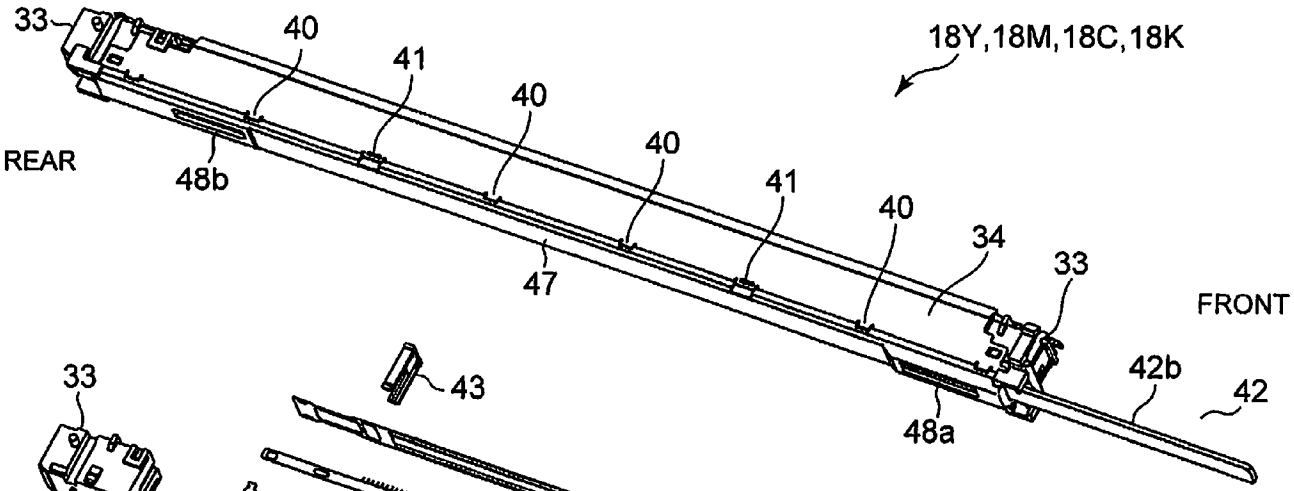
FIG. 2 is a schematic perspective view of the charger, as viewed from the bottom side according to an embodiment.
Figure 3:
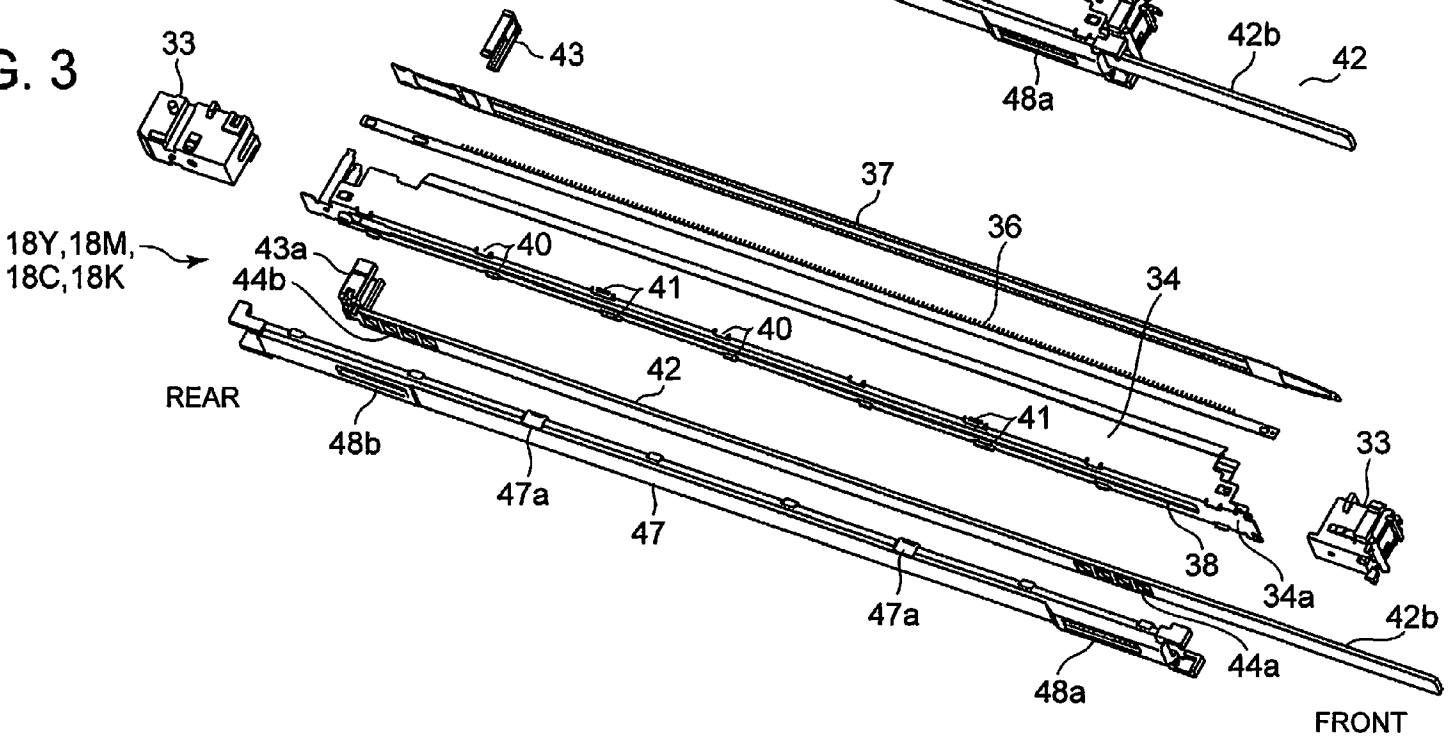
FIG. 3 is an exploded perspective view showing the charger according to an embodiment.

The respective chargers 18Y, 18M, 18C and 18K will be described in detail. The respective chargers 18Y, 18M, 18C and 18K have the same structure and therefore will be described using common reference numerals. The respective chargers 18Y, 18M, 18C and 18K include a metallic needle electrode 36 as a discharge member inside a case 34 supporting electrode terminals 33 on both sides as shown in FIGS. 2 and 3.

The case 34 includes a grid 37 in an opening that faces the respective photoconductive drums 17Y, 17M, 17C and 17K. The case 34 includes a guide hole 38 which is an air hole extending in the longitudinal direction of the case 34, in a bottom surface 34*a* as a first surface that is opposite to the grid 37. The case 34 includes plural guide pawls 40 and hooks 41 on both longitudinal lateral side parts of the bottom surface 34*a*. The air hole may be provided on a lateral side of the case 34.

The respective chargers 18Y, 18M, 18C and 18K have a flat plate-like cleaning rod 42 as a cleaner support member that slides along the bottom surface 34*a* of the case 34. A rear end part 43*a* of the cleaning rod 42 supports a cleaner 43 which cleans the needle electrode 36. The guide pawls 40 on the bottom surface 34*a* guide a longitudinal lateral edge of the cleaning rod 42. The guide hole 38 guides the cleaner 43.

Figure 4:
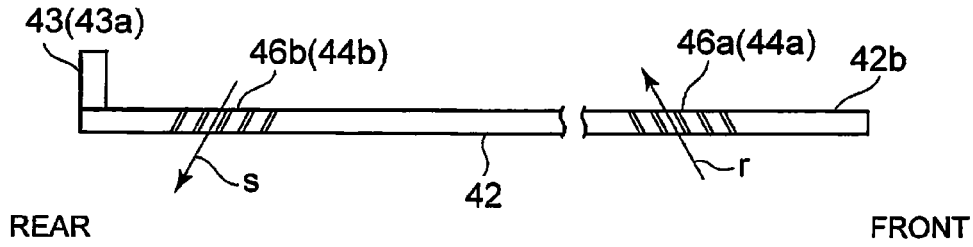
FIG. 4 is a schematic explanatory view showing a louver of a cleaning rod according to an embodiment.

The cleaning rod 42 has a flat plate-like shape and includes an air inlet port 44*a* and an air outlet port 44*b* in areas facing both sides of the guide hole 38 of the case 34. The cleaning rod 42 includes an operation part 42*b* for manual operation. As shown in FIG. 4, the cleaning rod 42 includes a louver 46*a* inclined in the direction of arrow r in the inlet port 44*a* and a louver 46*b* inclined in the direction of arrow s in the outlet port 44*b*.

The case 34 includes a cover 47 which covers the bottom surface 34*a* from the outside of the cleaning rod 42. The cover 47 is fixed on the bottom surface 34*a* of the case 34 by having fitting parts 47*a* mounted on the hooks 41 of the case 34. The cover 47 includes a front opening 48*a* and a rear opening 48*b* in areas facing the inlet port 44*a* and the outlet port 44*b*.

If the cleaning rod 42 is at a home position (the cleaner 43 is situated on the rear side of the case 34 and the front cover of the casing 1 is closed), the guide hole 38 of the case 34, the inlet port 44*a* of the cleaning rod 42 and the front opening 48*a* of the cover 47 connect with each other, and the guide hole 38 of the case 34, the outlet port 44*b* of the cleaning rod 42 and the rear opening 48*b* of the cover 47 connect with each other.

Figure 5:
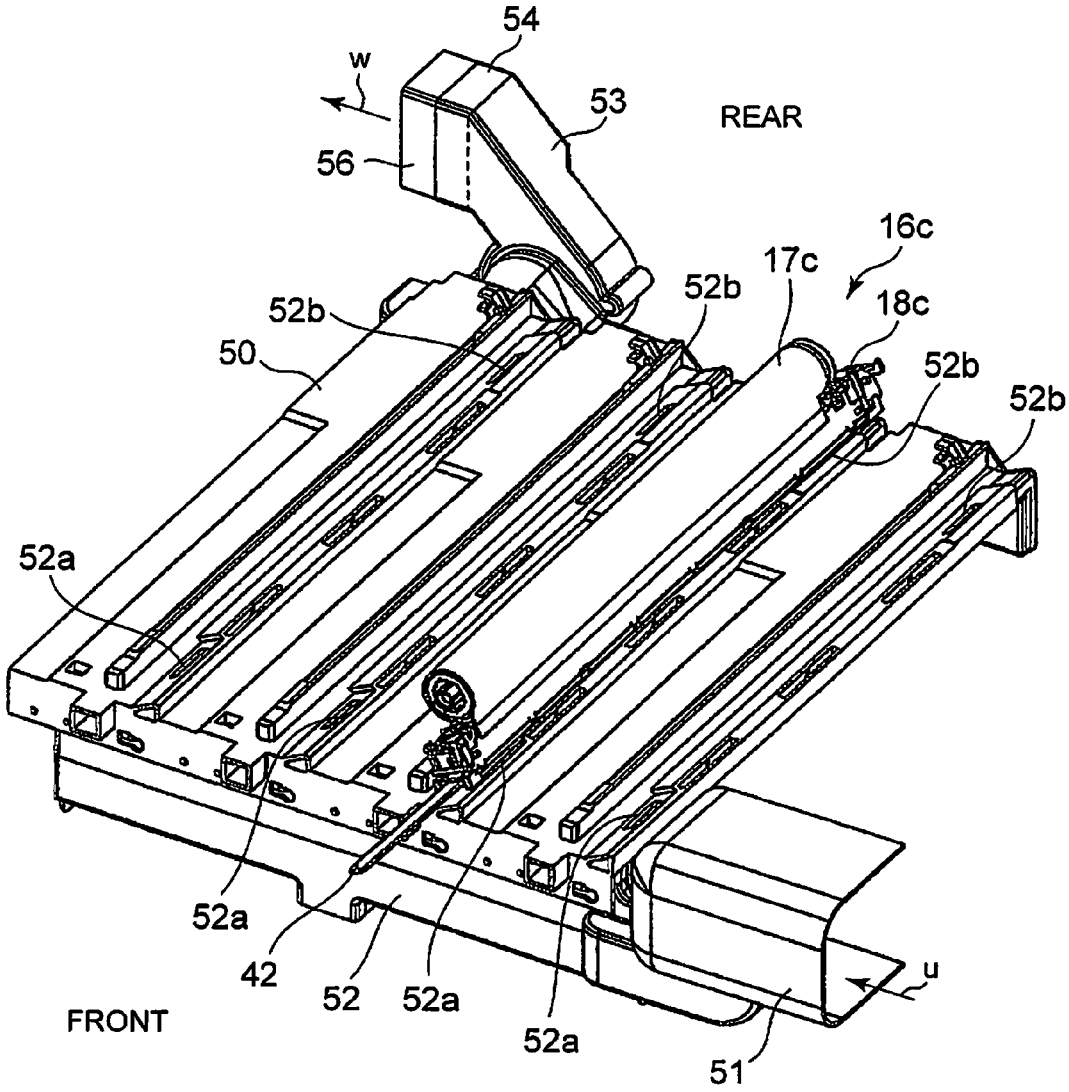
FIG. 5 is a schematic explanatory view showing a ventilation unit in which a photoconductive drum and a charger for C (cyan) are installed according to an embodiment.

As shown in FIG. 5, the ventilation unit 50 ventilates ozone generated, for example, in the four chargers 18Y, 18M, 18C and 18K in common. The ventilation unit 50, includes for example, an inlet duct 51 which takes in air from the front side of the casing 1, an air blast duct 52, and an outlet duct 53 which draws out the air inside the air blast duct 52 from the rear side of the casing 1. The outlet duct 53 includes a suction fan 54 and an ozone filter 56.

The air blast duct 52 includes, on the front side, a first opening 52*a* connecting with the front opening 48*a* of the cover 47 of the chargers 18Y, 18M, 18C and 18K. The air blast duct 52 includes, on the rear side, a second opening 52*b* connecting with the rear opening 48*b* of the cover 47 of the chargers 18Y, 18M, 18C and 18K.

At the time of the print process in the MFP 10, the cleaning rod 42 of the chargers 18Y, 18M, 18C and 18K is guided by the guide hole 38 and the guide pawls 40 and situated at the home position within the case 34. When the cleaning rod 42 is at the home position, the inlet port 44*a* of the cleaning rod 42, the front opening 48*a* of the cover 47 and the first opening 52*a* of the air blast duct 52 connect with each other on the front side of the MFP 10. When the cleaning rod 42 is at the home position, the outlet port 44*b* of the cleaning rod 42, the rear opening 48*b* of the cover 47 and the second opening 52*b* of the air blast duct 52 connect with each other on the rear side of the MFP 10.

Figure 6:
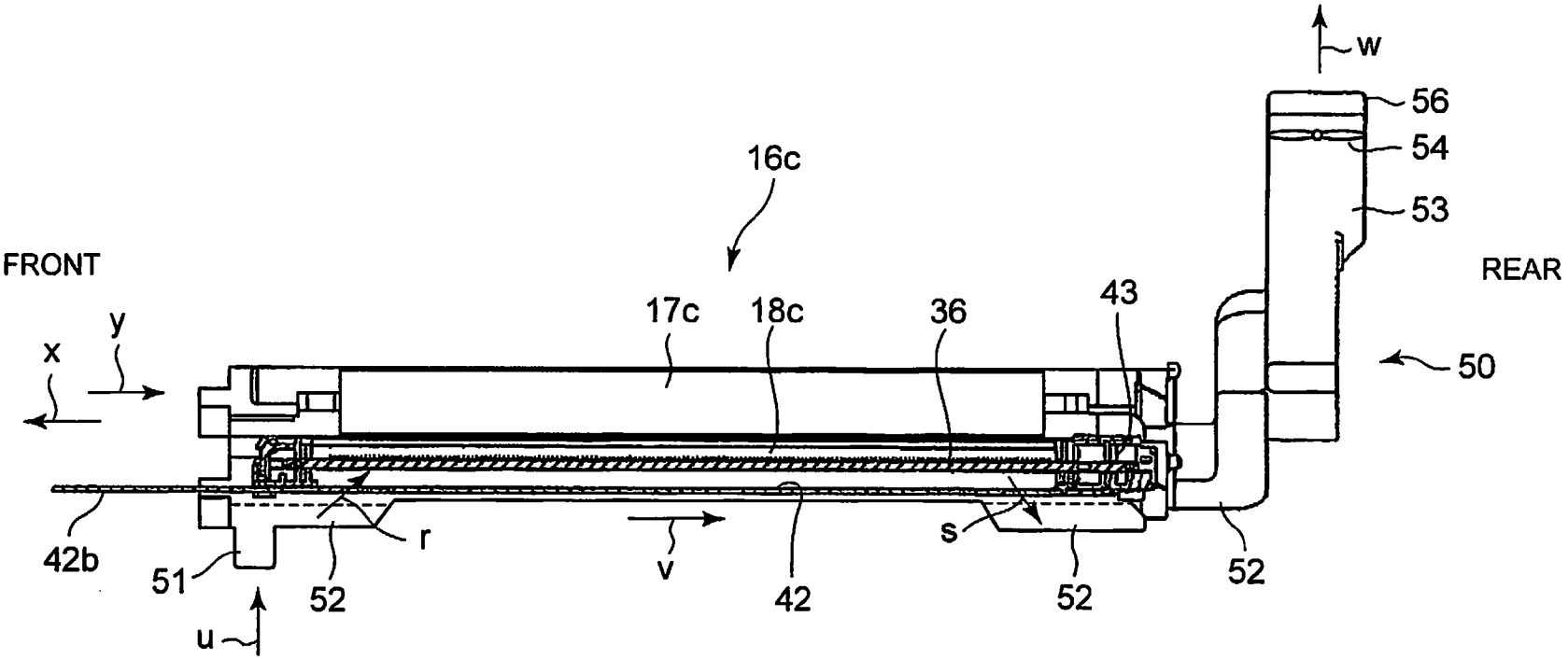
FIG. 6 is a schematic explanatory view showing the flow of air within the case of the C (cyan) charger, generated by the ventilation unit according to an embodiment.

For example, while the print process is carried out, the ventilation unit 50 drives the suction fan 54. By driving the suction fan 54, the ventilation unit 50 takes outside air around the MFP 10 into the inlet duct 51. As shown in FIG. 6, the ventilation unit 50 flows the air which is taken in the direction of arrow u toward the front side of the air blast duct 52.

The air blast duct 52 sends the air from the front side of the guide hole 38 to the case 34, via the front opening 48*a* and the inlet port 44*a* connecting with the first opening 52*a*. At the inlet port 44*a*, the air flows into the case 34, inclined in the direction of arrow r by the louver 46*a*.

The air flowing into the case 34 generates an air current in the direction of arrow v. The air flowing in the direction of arrow v inside the case 34 flows to the rear side of the air blast duct 52 from the second opening 52*b* connecting with the rear opening 48*b*, via the outlet port 44*b* from the front side of the guide hole 38 and is discharged. At the outlet port 44*b*, the air inside the case 34 is discharged into the air blast duct 52, inclined in the direction of arrow s by the louver 46*b*.

The ventilation unit 50 sucks the air flowing through the case 34 and discharged into the air blast duct 52, in the direction of arrow w from the outlet duct 53, and discharges the air outward from the MFP 10.

By a corona discharge to the photoconductive drums 17Y, 17M, 17C and 17K from the needle electrode 36 in the print process, ozone is generated inside the case 34. The ozone generated by the corona discharge flows out to the rear side of the air blast duct 52 from the case 34, together with the air currents in the directions of arrows v and inside the case 34 generated by the ventilation unit 50.

The ozone discharged into the air blast duct 52 is sucked into the outlet duct 53 by the suction fan 54. The ventilation unit 50 eliminates the ozone contained in the air with the ozone filter 56 and then discharges the air that does not contain the ozone outward from the MFP 10 from the outlet duct 53. The ventilation unit 50 draws the ozone generated by the corona discharge from the needle electrode 36 into the outlet duct 53 from inside the case 34 via the air inlet port 44*a* and the air outlet port 44*b* of the cleaning rod 42. The ozone generated by the corona discharge from the needle electrode 36 is eliminated from the case 34. The photoconductive drums 17Y, 17M, 17C and 17K are prevented from being exposed to a high concentration of ozone generated at the time of charging.

Stain may adhere to the needle electrode 36 during the print process in the MFP 10. The stain on the needle electrode 36 may cause uneven charging of the photoconductive drums 17Y, 17M, 17C and 17K and therefore may result in deterioration in image quality. The stain on the needle electrode 36 may be manually cleaned, for example, in predetermined timing that is set in advance or when necessary.

To clean the needle electrode 36, the front cover of the MFP 10 is opened, then the operation part 42*b* protruding on the front side of the cleaning rod 42 is operated, and the cleaning rod 42 is reciprocated in the direction of arrow x toward the front, and in the direction of arrow y toward the rear. As the cleaner 43 is guided by the guide hole 38, the position accuracy of the cleaner 43 in relation to the needle electrode 36 is enhanced.

While the cleaning rod 42 is reciprocated in the x and y directions, the cleaner 43 securely slides in contact with the tip of the needle electrode 36 and cleans the adhering matter on the needle electrode 36. After the cleaning ends, the cleaning rod 42 is slid in the y direction and the cleaning rod 42 is returned to the home position. The cleaning rod 42 can also be reciprocated plural times to clean the needle electrode 36.

As the cleaning rod 42 is returned to the home position, the front cover of the MFP 10 is closed. If the cleaning rod 42 is not returned to the home position, the front cover interferes with an end part of the cleaning rod 42 and the front cover cannot be closed.

According to this embodiment, the air inlet port 44*a* and the air outlet port 44*b* are formed in the cleaning rod 42. The air flowing through the air blast duct 52 of the ventilation unit 50 is sent into the case 34 from the inlet port 44*a* and the air inside the case 34 is discharged to the rear side of the air blast duct 52 from the outlet port 44*b*. The air current heading toward the outlet port 44*b* from the inlet port 44*a* is generated inside the case 34. The ozone inside the case 34 is discharged into the outlet duct 53, and preventing the photoconductive drums 17Y, 17M, 17C and 17K from being exposed to a high concentration of ozone.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A charger comprising:

a discharge member which faces an image carrier;

a case which supports the discharge member and comprises an air hole in a first surface;

a cleaner which contacts with the discharge member; and a cleaner support member which comprises an inlet port and an outlet port connecting with the air hole and a ventilation unit, supports the cleaner, and slides in relation to the case on the first surface.

2. The charger of claim 1, wherein the case comprises a guide for the cleaner support member, on the first surface.

3. The charger of claim 1, wherein the cleaner support member comprises a louver at the inlet port and the outlet port.

4. The charger of claim 1, wherein the discharge member comprises plural needle electrodes arrayed in a longitudinal direction.

5. The charger of claim 1, wherein the case forms an air flow path heading from the inlet port toward the outlet port.

6. An image forming apparatus comprising:

an image carrier;

a ventilation unit which takes in air outside a body which houses the image carrier and discharges the air outward from the body;

a discharge member which faces the image carrier;

a case which supports the discharge member and comprises an air hole in a first surface;

a cleaner which contacts with the discharge member;

a cleaner support member which comprises an inlet port and an outlet port connecting with the air hole and the ventilation unit, supports the cleaner, and slides in relation to the case on the first surface;

a latent image forming unit which forms an electrostatic latent image on the image carrier charged by the discharge member; and a developing unit which provides a toner to the electrostatic latent image.

7. The apparatus of claim 6, wherein the case comprises a guide for the cleaner support member, on the first surface.

8. The apparatus of claim 6, wherein the cleaner support member comprises a louver at the inlet port and the outlet port.

9. The apparatus of claim 6, wherein the discharge member comprises plural needle electrodes arrayed in a longitudinal direction.

10. The apparatus of claim 6, wherein the case forms an air flow path heading from the inlet port toward the outlet port.

* * * * *